US006700098B1

(12) United States Patent
Wyatt et al.

(10) Patent No.: US 6,700,098 B1
(45) Date of Patent: Mar. 2, 2004

(54) SYSTEM FOR PREVENTING AND CLEARING ICE DAMS

(76) Inventors: Angela Wyatt, 6305 Belltree La., Flint, MI (US) 48504; Blair Sutton, P.O. Box 418, Ottawa, KS (US) 66067

( * ) Notice: Subject to any disclaimer, the term of this patent is extended or adjusted under 35 U.S.C. 154(b) by 0 days.

(21) Appl. No.: 10/413,939

(22) Filed: Apr. 15, 2003

(51) Int. Cl.[7] ..... H05B 3/00

(52) U.S. Cl. ..... 219/213; 219/494; 219/536; 219/549; 338/214; 338/315; 248/70

(58) Field of Search ..... 219/494, 213, 219/536, 520, 542, 549, 528; 248/59, 58, 70; 338/214, 315–318; 174/43, 40 TD, 40 CC

(56) References Cited

U.S. PATENT DOCUMENTS

| | | | | | |
|---|---|---|---|---|---|
| 3,074,676 | A | * | 1/1963 | Watson | 248/71 |
| 3,388,738 | A | * | 6/1968 | Dery | 165/47 |
| 3,582,612 | A | | 6/1971 | Siemianowski | |
| 3,725,638 | A | | 4/1973 | Solin et al. | |
| 4,043,527 | A | * | 8/1977 | Franzmeier | 248/65 |
| 4,335,299 | A | | 6/1982 | Belohlavek | |
| 4,401,880 | A | * | 8/1983 | Eizenhoefer | 219/213 |
| 4,419,569 | A | | 12/1983 | Colten | |
| 5,391,858 | A | * | 2/1995 | Tourangeau et al. | 219/213 |
| 5,535,511 | A | * | 7/1996 | Karasik | 29/872 |
| 5,763,858 | A | | 6/1998 | Jones | |
| 5,878,533 | A | | 3/1999 | Swanfeld, Jr. | |
| 6,215,102 | B1 | | 4/2001 | Jones | |
| 6,225,600 | B1 | | 5/2001 | Burris | |
| 6,297,475 | B2 | | 10/2001 | Jones | |

FOREIGN PATENT DOCUMENTS

| | | | |
|---|---|---|---|
| EP | 54115 | * | 6/1982 |
| JP | 1-126119 | * | 5/1989 |

* cited by examiner

*Primary Examiner*—John A. Jeffery
(74) *Attorney, Agent, or Firm*—Dale J. Ream

(57) ABSTRACT

A system for preventing and clearing gutter ice dams includes a plurality of wire holding assemblies, each assembly having a base for attachment to a gutter and a length-adjustable arm for contact with a roof adjacent the gutter. The arm is rotatably and pivotally mounted to the base. The system includes a PTCR heating cable that is held in a desired position by the wire holding assembly arms. The system includes roof and gutter temperature sensors and a moisture sensor. The heating cable is connected to the control unit, the control having a mode selector switch for controlling operation of the cable. In an automatic mode, the heating cable is energized if a roof temperature is greater than a predetermined temperature and a gutter temperature is less than a predetermined temperature. In a timer mode, the heating cable is energized for a selectable time.

20 Claims, 12 Drawing Sheets

Gutter Clear Components

Gutter Clear Modes

Automatic Mode 1

Automatic Mode 2

SYSTEM FOR PREVENTING AND CLEARING ICE DAMS

BACKGROUND OF THE INVENTION

This invention relates generally to deicing systems and, more particularly, to a system for preventing and clearing ice dams from roof gutters and downspouts.

Ice and snow on the roof of a house or building melts as heat from the building warms the roof. Water from the melting ice and snow then runs to the edges or "eaves" of the roof and into a gutter or eave trough where it tends to refreeze. This refrozen water forms an ice dam at the roof edge or in the gutter which can be damaging to the house or building structure in that additional water from melting snow may pool up and seep through the roof into the house, causing damage to drywall, insulation, etc. Further, additional water may contribute to increasing the size and weight of the ice dam.

Various deicing systems have been proposed in the art for clearing ice and snow from gutters mounted to a roof edge. Although assumably effective for their intended purposes, the existing systems do not provide for selective placement of a heating cable on a roof surface itself as well as in a gutter and associated downspouts. Further, the existing systems do not provide convenient user controls that improve utility and energy conservation.

Therefore, it is desirable to have a system for preventing and clearing ice dams for use with gutters and downspouts that includes rotatable, pivotal, and telescopic heat cable holding assemblies. Further, it is desirable to have a system that utilizes a self-regulating heat cable having a plurality of sections that respond independently to changes in ambient temperature. In addition, it is desirable to have a system having multiple modes of operation for optimal user control of the system.

SUMMARY OF THE INVENTION

An ice dam prevention and clearing system for use with gutters and downspouts mounted to a roof includes a plurality of wire holding assemblies, each assembly having a base for attachment to a gutter panel and an elongate arm coupled to the base. The system further includes a heating cable for generating beat when electrically actuated. Each assembly arm includes at least one fastener for retaining the heating cable. Each arm is rotatably and pivotally coupled to a respective base such that the arm may be laterally positioned on a roof surface adjacent a gutter or completely displaced from the roof surface. In addition, each arm is length adjustable such that the heating cable may be vertically extended along the roof surface. The heating cable may also be positioned in the gutter itself. Therefore, this system may heat a roof surface adjacent a gutter so as to prevent the formation of an ice dam or to eliminate an existing ice dam so that the melted water may flow through the gutter. The heating cable is connected to a control unit that includes a selector switch for selecting a mode of operation.

Therefore, a general object of this invention is to provide a system for the prevention and clearing of an ice dam in or adjacent a gutter mounted to the edge of a roof.

Another object of this invention is to provide an ice dam prevention and clearing system, as aforesaid, which includes a plurality of wire holding assemblies that may be spaced apart along a gutter for holding a heating cable.

Still another object of this invention is to provide an ice dam prevention and clearing system, as aforesaid, in which an arm of each wire holding assembly is pivotally and rotatably coupled to a base for positioning the arm at a desired position relative to a roof surface.

Yet another object of this invention is to provide an ice dam prevention and clearing system, as aforesaid, in which the arm of each wire holding assembly is telescopically length adjustable.

A further object of this invention is to provide an ice dam prevention and clearing system, as aforesaid, that provides a plurality of user-selectable modes for operation of the system.

A still further object of this invention is to provide an ice dam prevention and clearing system, as aforesaid, including temperature and moisture sensors for determining when the heating cable is energized.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
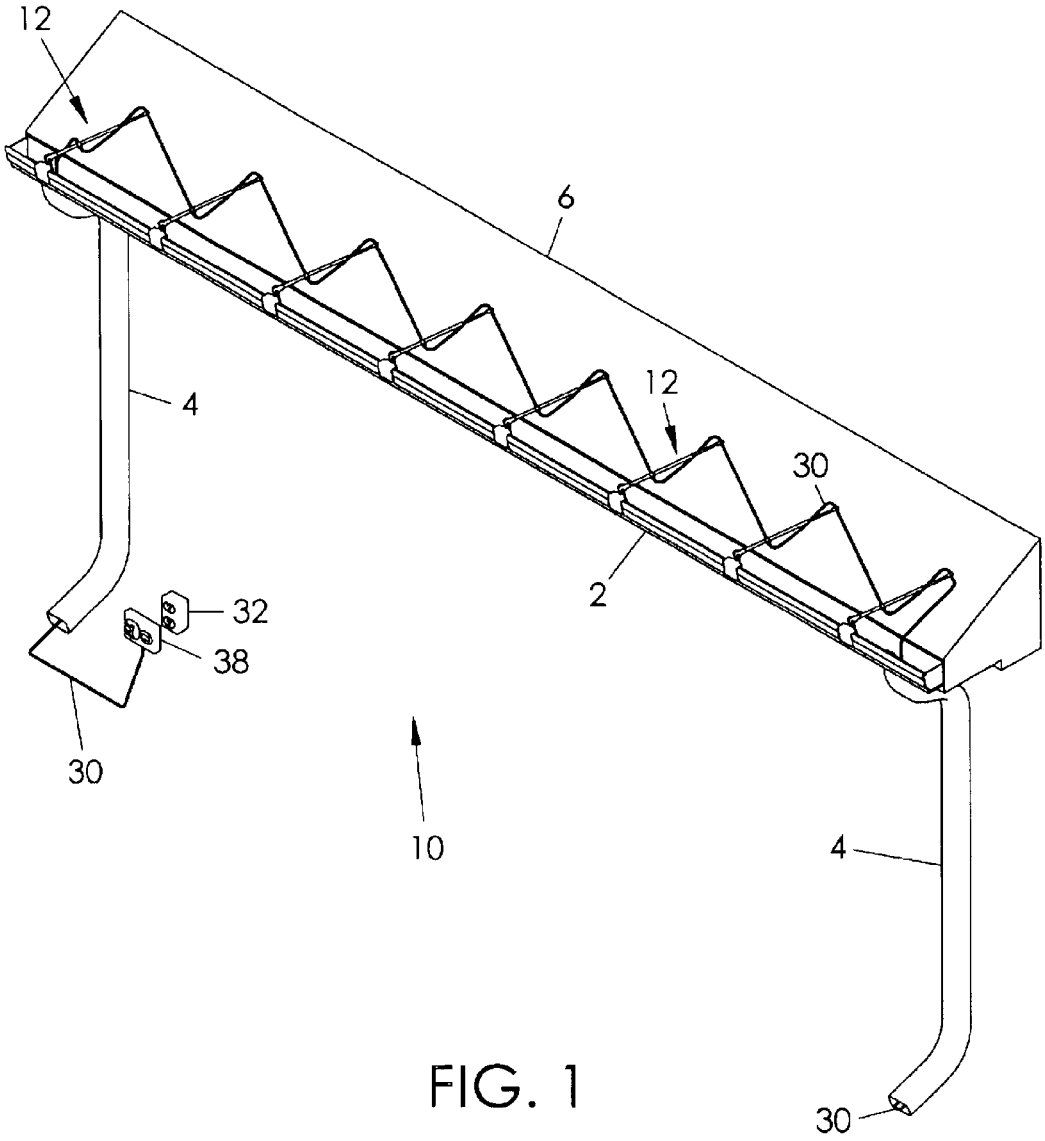
FIG. 1 is a perspective view of a ice dam prevention and clearing system according to a preferred embodiment of the present invention in use with a gutter and associated downspouts.
Figure 2:
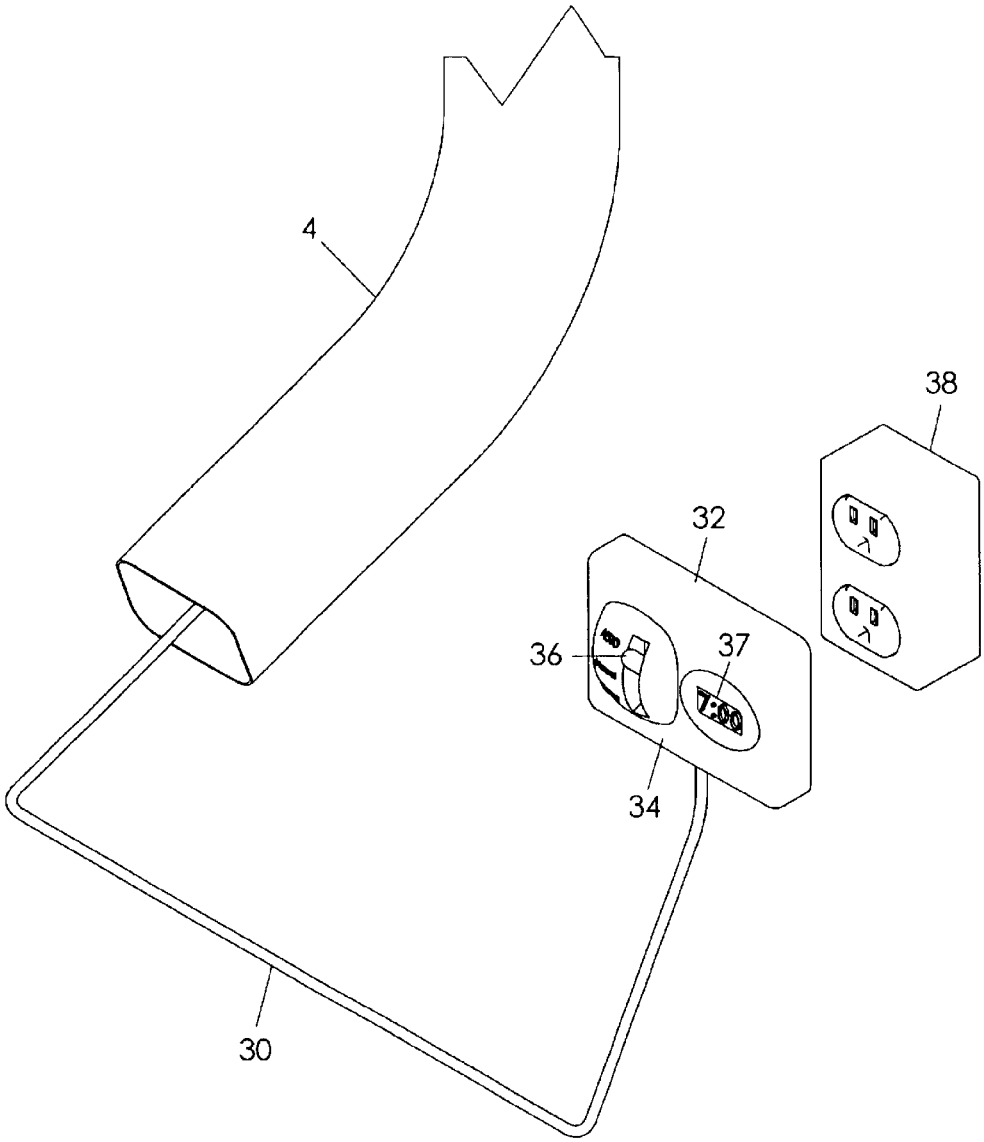
FIG. 2 is a fragmentary perspective view of the system as in FIG. 1 showing the control unit on an enlarged scale.
Figure 3:
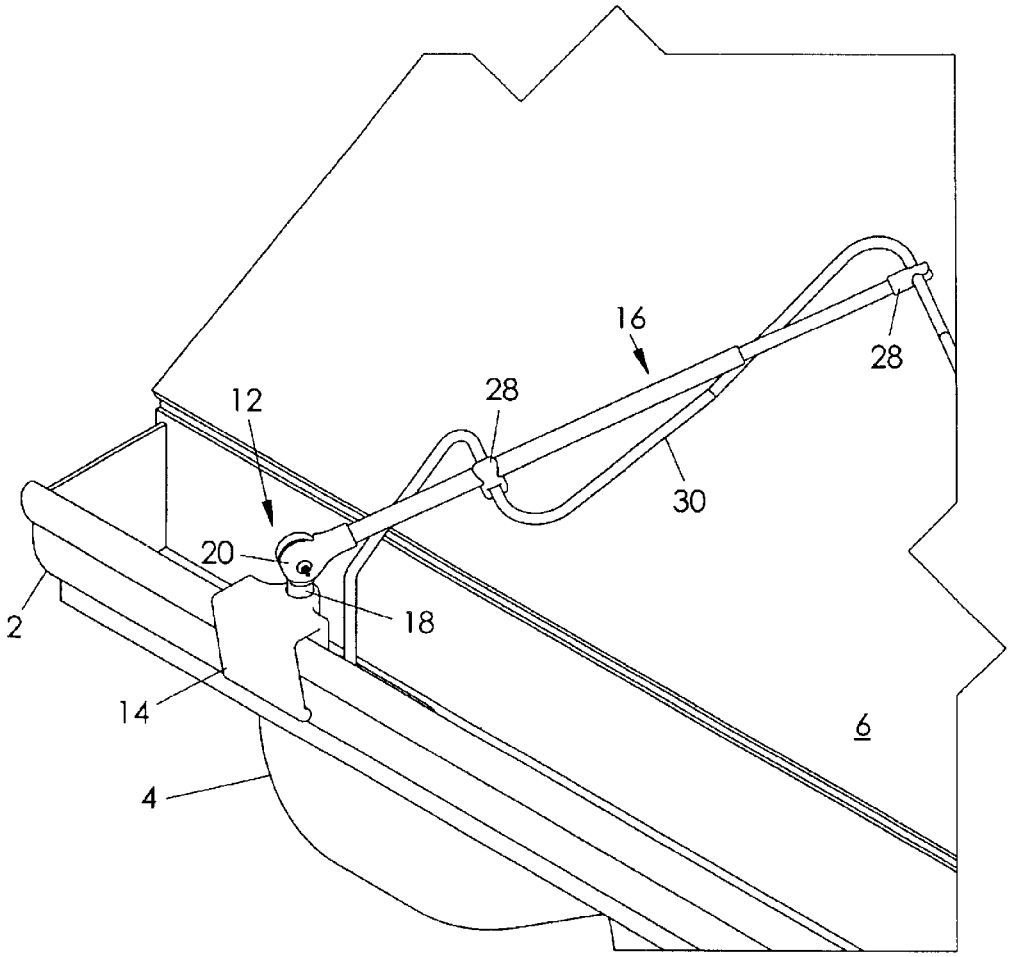
FIG. 3 is a fragmentary perspective view of the system as in FIG. 1 showing a wire holding assembly and heating cable on an enlarged scale.
Figure 4:
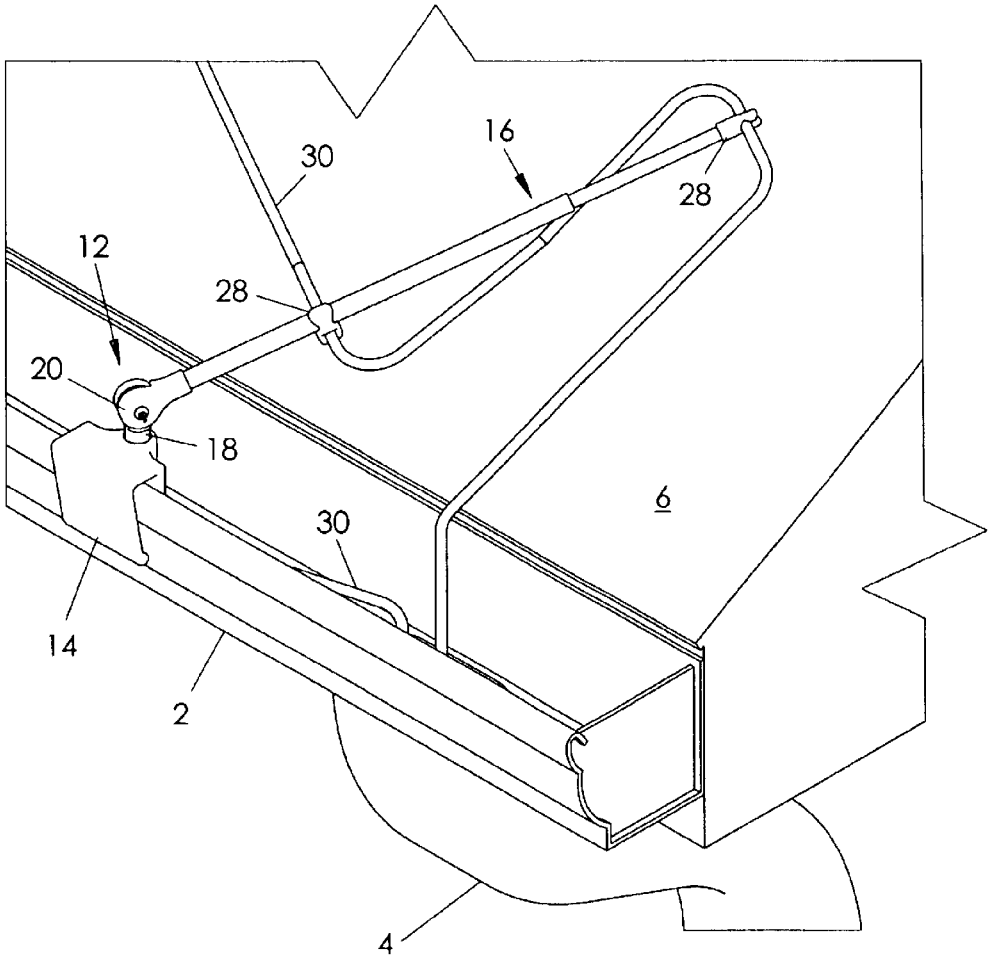
FIG. 4 is a fragmentary perspective view of the system as in FIG. 1 on an enlarged scale and taken from another angle.
Figure 5:
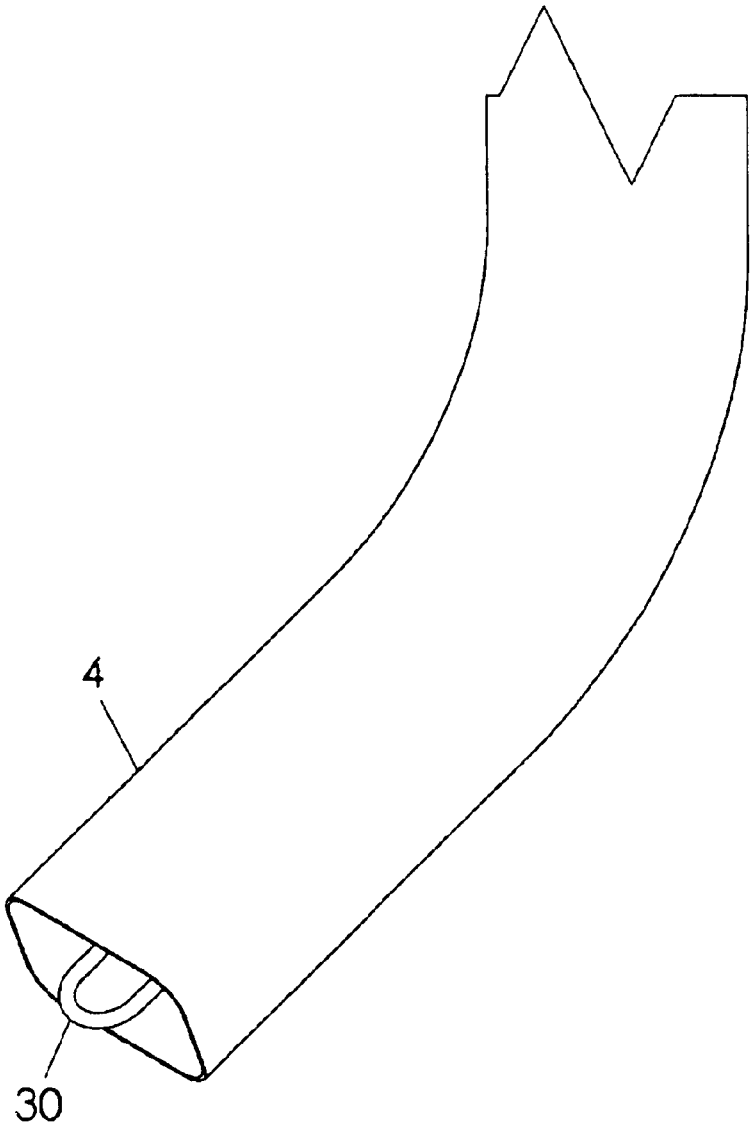
FIG. 5 is a fragmentary perspective view on an enlarged scale of an end of a downspout as in FIG. 1.

An ice dam prevention and clearing system 10 according to the preferred embodiment will now be described in detail with reference to FIGS. 1 through 12 of the accompanying drawings. The system may be installed for use with gutters 2 attached to edges of a roof 6 (FIG. 1).

Figure 6:
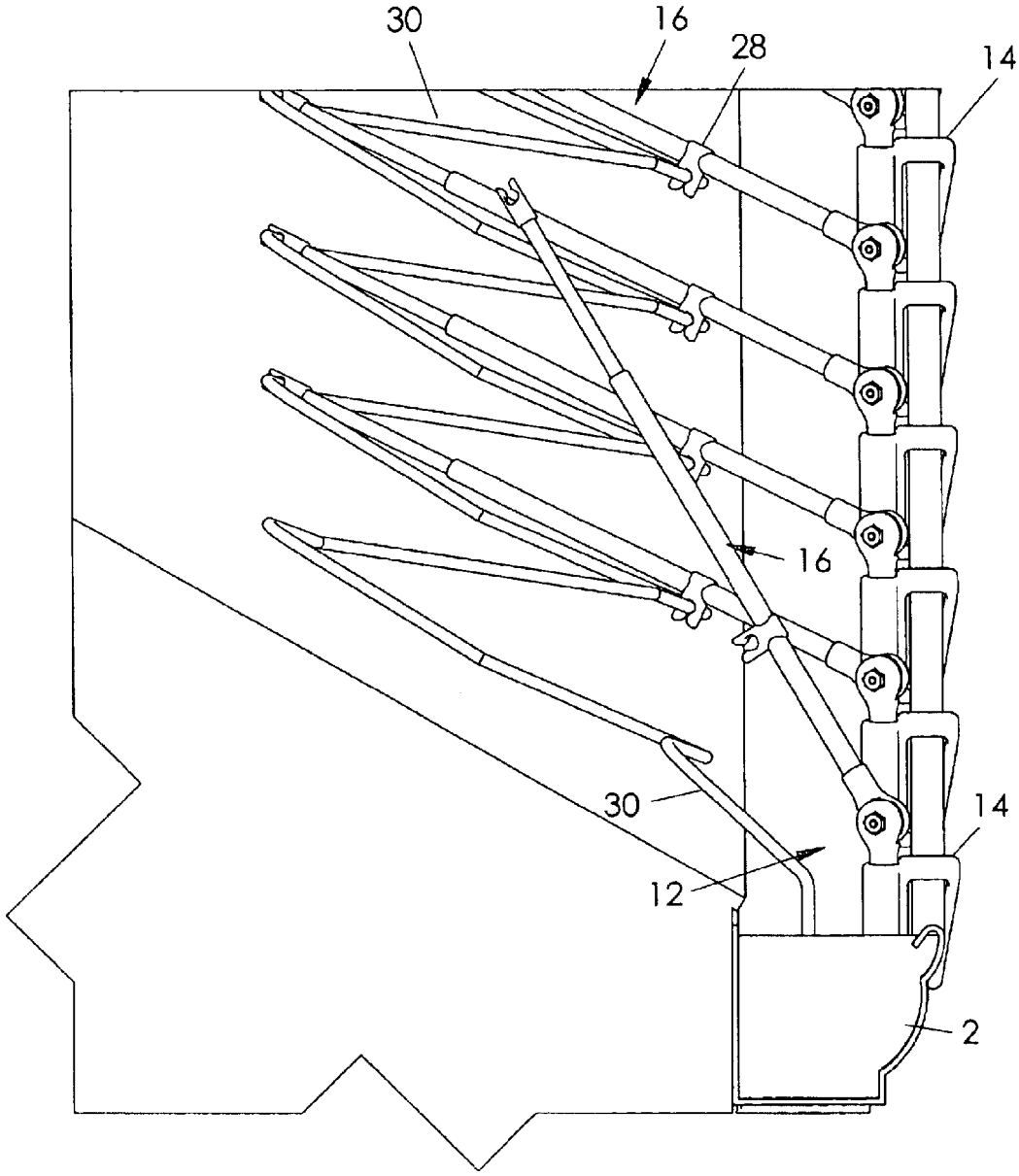
FIG. 6 is a perspective view of a plurality of wire holding assemblies as in FIG. 1 with an arm of one of the assemblies in a configuration displaced from a roof surface.
Figure 7:
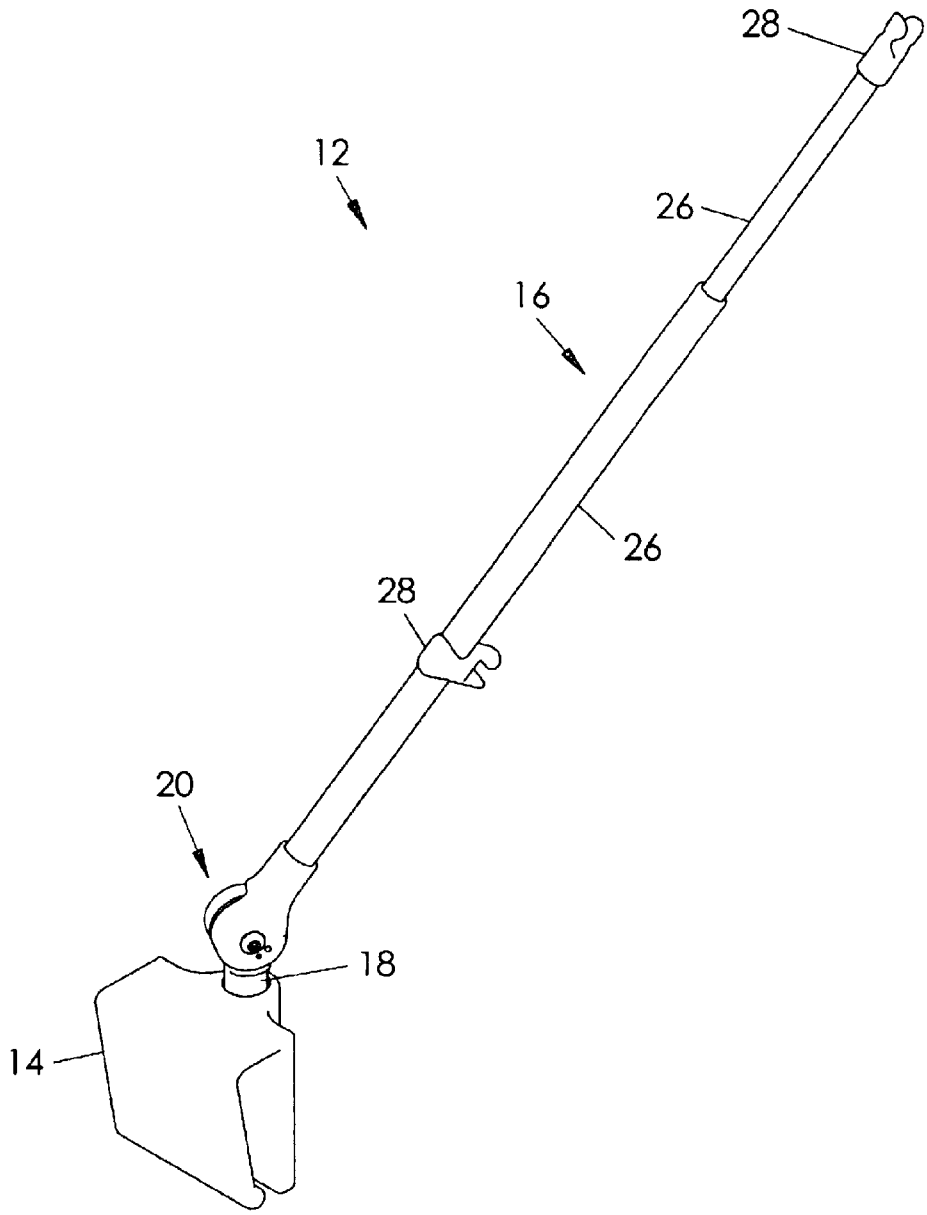
FIG. 7 is a perspective view of a wire holding assembly as in FIG. 1 on an enlarged scale and removed from attachment to a gutter.
Figure 8:
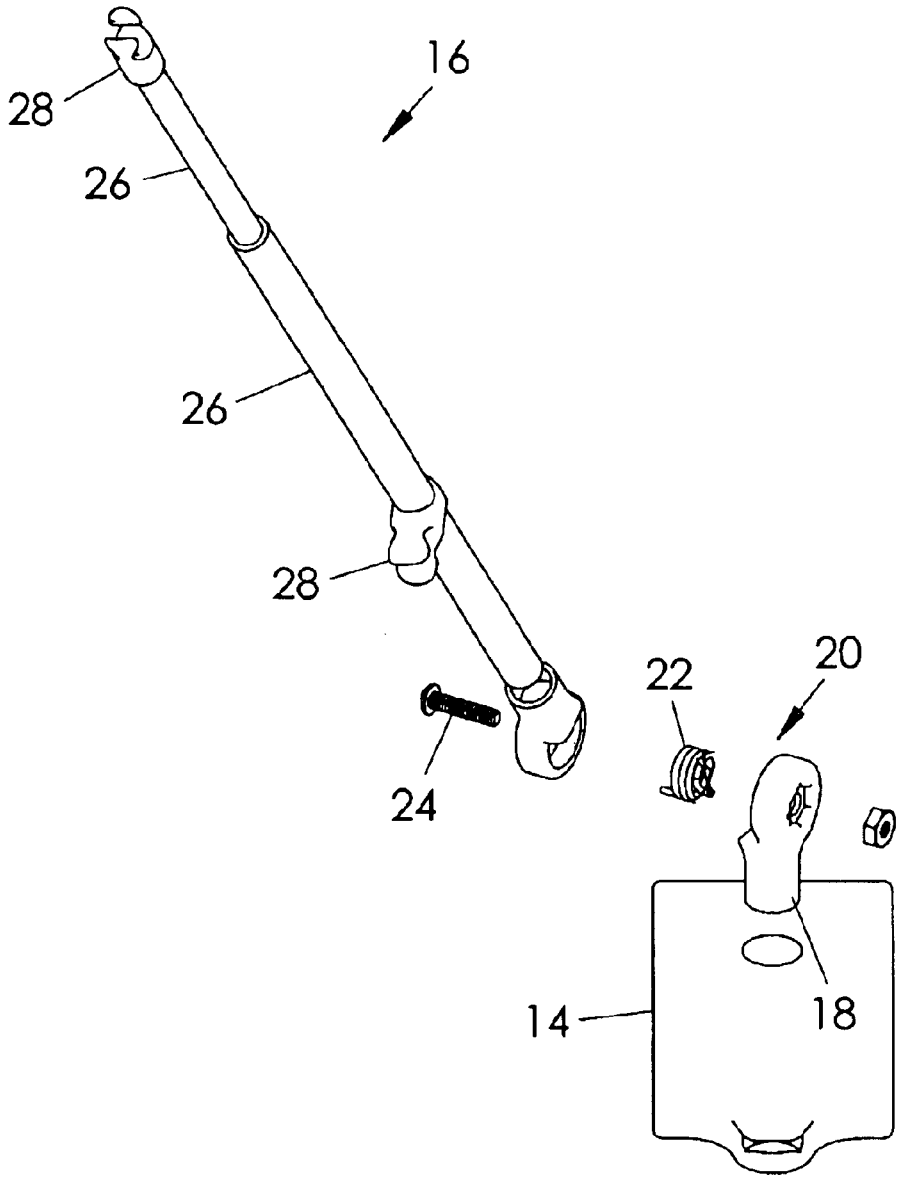
FIG. 8 is an exploded view of the wire holding assembly as in FIG. 7.

The system 10 includes a plurality of wire holding assemblies, each holding assembly 12 having a base 14 and an elongate arm 16 coupled to the base 14 (FIG. 7). More particularly, the base 14 includes a generally inverted U-shaped configuration and is constructed of spring steel or aluminum although a durable plastic construction would also be suitable. Lower edges of the base 14 are biased toward one another such that the base 14 may be frictionally attached to the elongate front wall of a gutter 2. The arm 16 of each wire holding assembly 12 includes a mounting shaft 18 that is rotatably coupled to the base 14 (FIGS. 7 and 8). The mounting shaft 18 establishes an imaginary vertical axis about which the entire arm 16 may rotate, thus allowing the arm 16 to be positioned laterally along a roof surface (FIG. 1). Further, the arm 16 includes a spring-loaded coupling 20 for pivotally mounting the arm 16 to the mounting shaft 18 which, in turn, is coupled to the base 14. This spring-loaded coupling 20 includes a spring 22 and a bolt 24, pin, or the like (FIG. 8) such that the arm 16 is pivotally movable about an imaginary horizontal axis of the bolt 24, the arm 16 being movable between a first configuration in contact with a roof surface 6 (FIG. 3) and a second configuration displaced from the roof surface (FIG. 6).

Each arm 16 includes a plurality of telescopic sections 26 such that the arm is length-adjustable. A first telescopic section is connected to the mounting shaft 18 that, in turn, is rotatably coupled to the base 14. Further, a plurality of wire fasteners 28 is mounted to the arm 16 (FIG. 7) although each arm may include only a single fastener 28.

The system 10 includes a self-regulating heating cable 30 for generating heat when electrically energized, as to be described in more detail below. Preferably, the heating cable 30 is a conductive polymeric temperature coefficient of resistance (PTCR) cable having a polymeric core with embedded graphite. The PTCR cable includes a plurality of sections, each of which responds independently to changes in ambient temperature. When energized, the PTCR cable produces an amount of heat for melting ice and snow with which it is in contact. The amount of heat is dependent upon the ambient temperature surrounding the cable. The polymeric formulation of the PTCR cable causes the amount of heat output produced by the cable to vary in an inversely proportionate relationship to changes in temperature. In other words, the heat output increases when the ambient air is colder and decreases when warmer. Specifically, as the core temperature increases, the number of conductive paths in the core material decreases, automatically decreasing heat output. This inverse relationship has the effect of saving energy as temperature increases. The heating cable 30 may be retained by the fasteners 28 of each wire holding assembly 12 for covering a substantial portion of a roof surface 6 adjacent a gutter 2. The heating cable 30 may also be positioned in the gutter 2 itself and may even be extended through associated downspouts 4 (FIGS. 1–5).

Figure 10A:
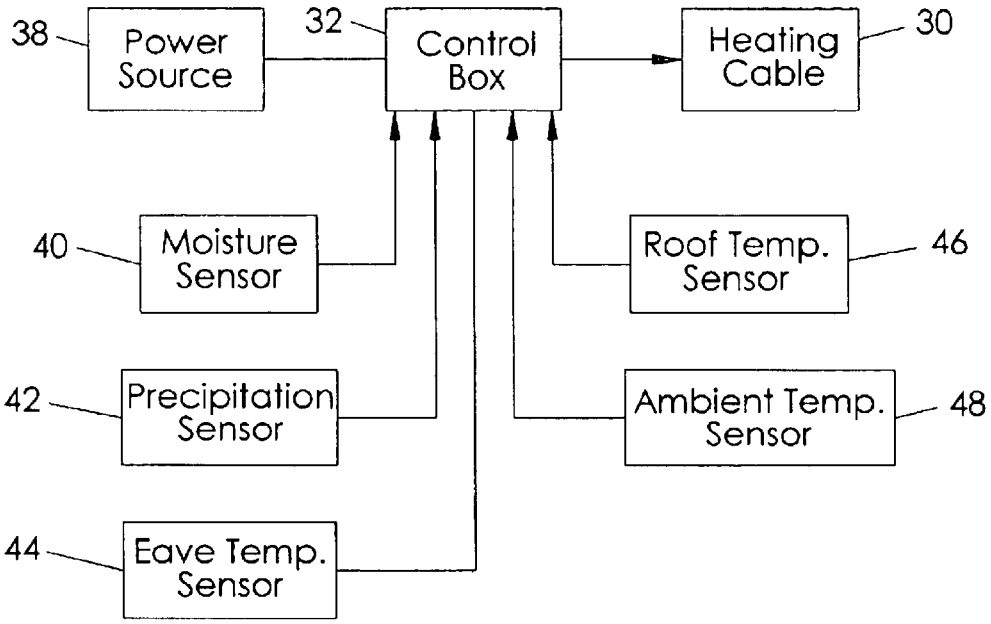
FIG. 10*a* is a block diagram of the electrical components of the preferred embodiment of the ice dam prevention and clearing system.

The system 10 further includes a control unit 32 (also referred to as a control box) for connection to a conventional electrical power source such an AC wall outlet 38 (FIG. 1). The control unit 32 includes a central processing unit (CPU) for controlling system operations and mode selections, as to be described more fully below. The heating cable 30 is electrically connected to the control unit 32 (FIG. 5) for control by the CPU. The system 10 also includes sensors for determining if conditions are suitable for activation of the heating cable 30. More particularly, the system may include a moisture sensor 40, a precipitation sensor 42, an eave temperature sensor 44, a roof temperature sensor 46, and an ambient air temperature sensor 48 (FIG. 10*a*). While all of these sensors may be directly connected to the CPU with electrical wires in a conventional manner, it would also be suitable for the sensors to communicate remotely with the CPU, such as through radio frequency transmission or the like. In either case, the sensors deliver respective data signals to the CPU. The sensors are generally positioned adjacent the heating cable 30.

Figure 9:
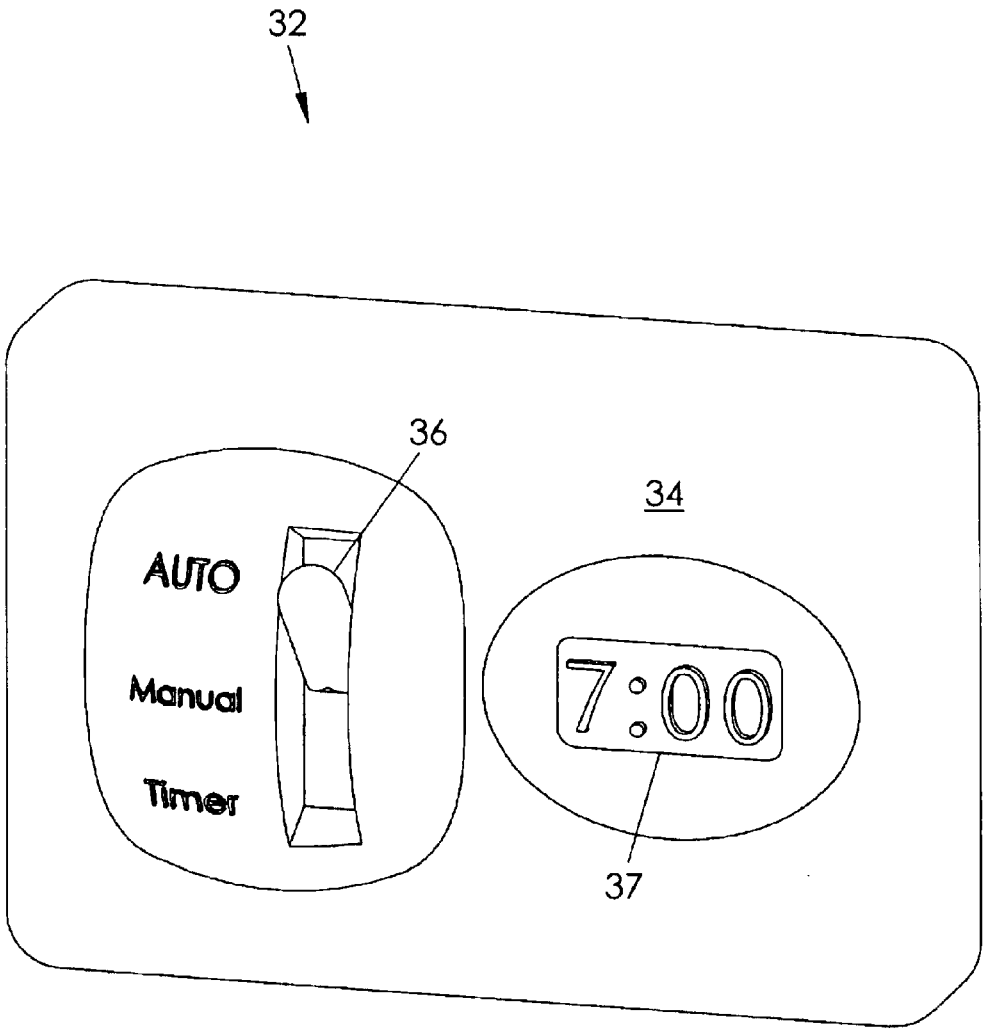
FIG. 9 is front view on an enlarged scale of the control panel of the control unit as in FIG. 1.
Figure 10B:
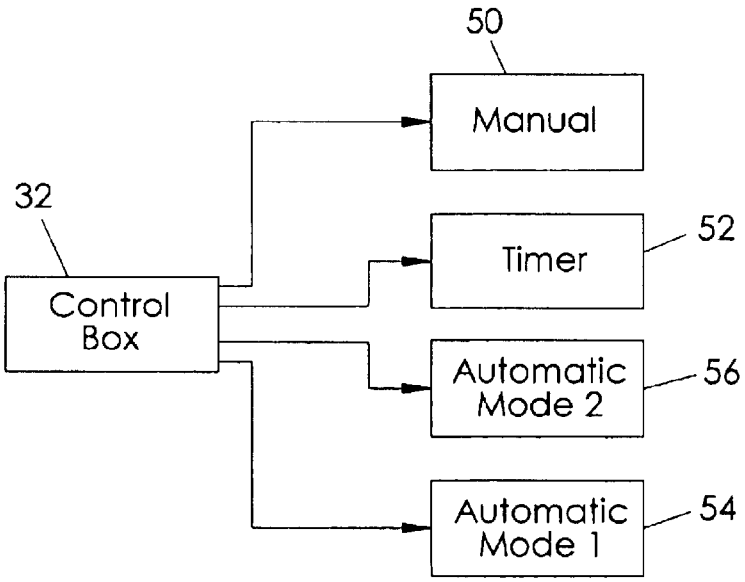
FIG. 10*b* is a block diagram illustrating the modes of operation implemented by system central processing unit (CPU)
Figure 11:
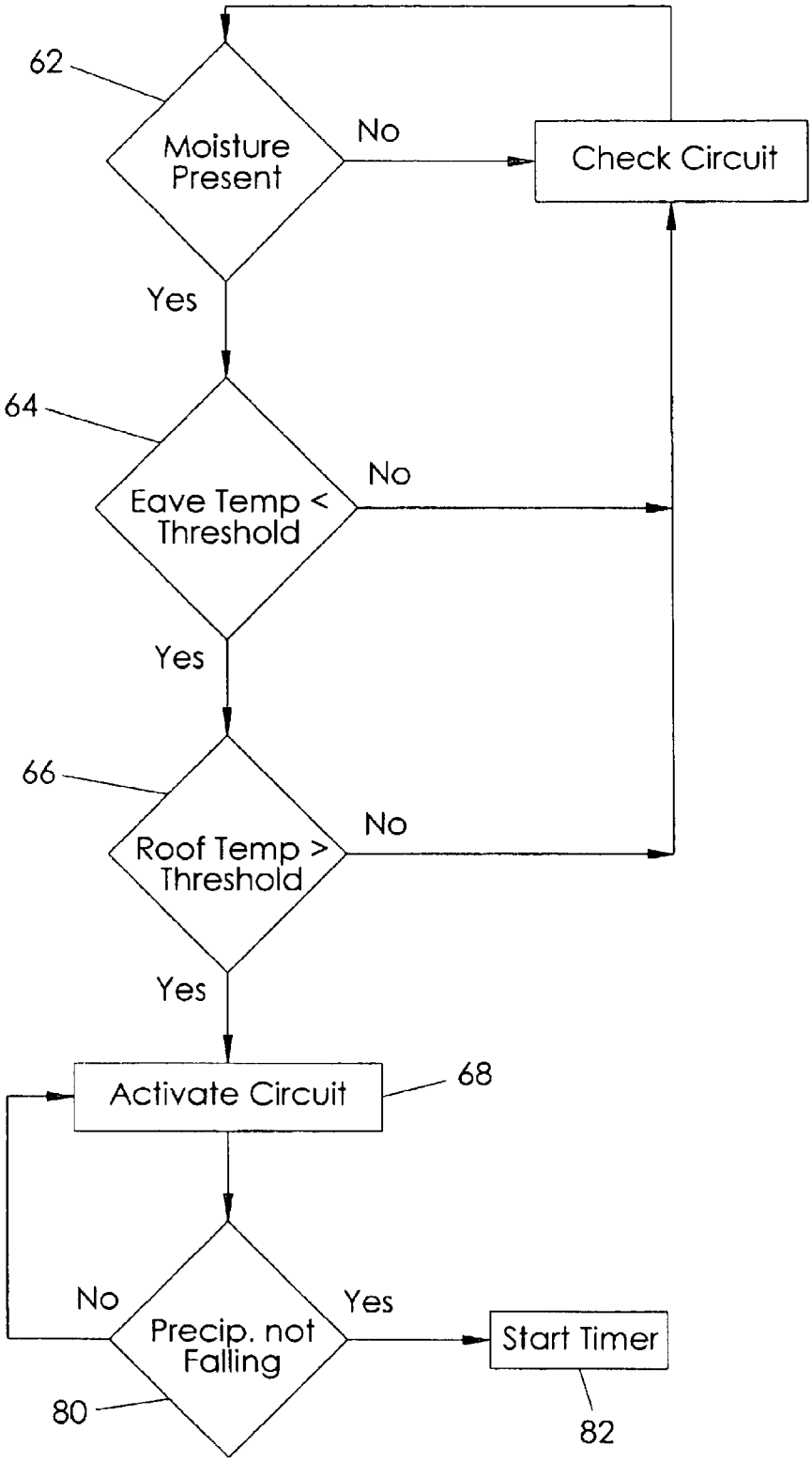
FIG. 11 is a flowchart illustrating the program logic implemented by the CPU according to one mode of operation.

The control unit 32 includes a control panel 34 having a selector switch 36. The selector switch 36 is pivotally movable between "Auto", "Manual", and "Timer" configurations (FIG. 9). More particularly, there are two "Auto" mode selection options. The selector switch configurations correspond to CPU-controlled modes as shown in FIG. 10*b*. When the "manual" mode 50 is selected, the CPU immediately energizes the heating cable 30 until the mode is changed or electrical power is otherwise interrupted. Operation of a first automatic mode 54 is illustrated in FIG. 11. The heating cable 30 is only energized 68 when the moisture sensor 40 indicates the presence of moisture 62 and when the eave temperature sensor 44 indicates a temperature less than a predetermined temperature 64, e.g. 32° F., and the roof temperature sensor 46 indicates a temperature greater than a predetermined temperature 66, e.g. 32° F. In other words, the heating cable 30 is energized only when all three conditions are present: moisture is present, melting is occurring on the roof surface 6, and freezing is occurring at the eave/gutter 2.

Figure 12:
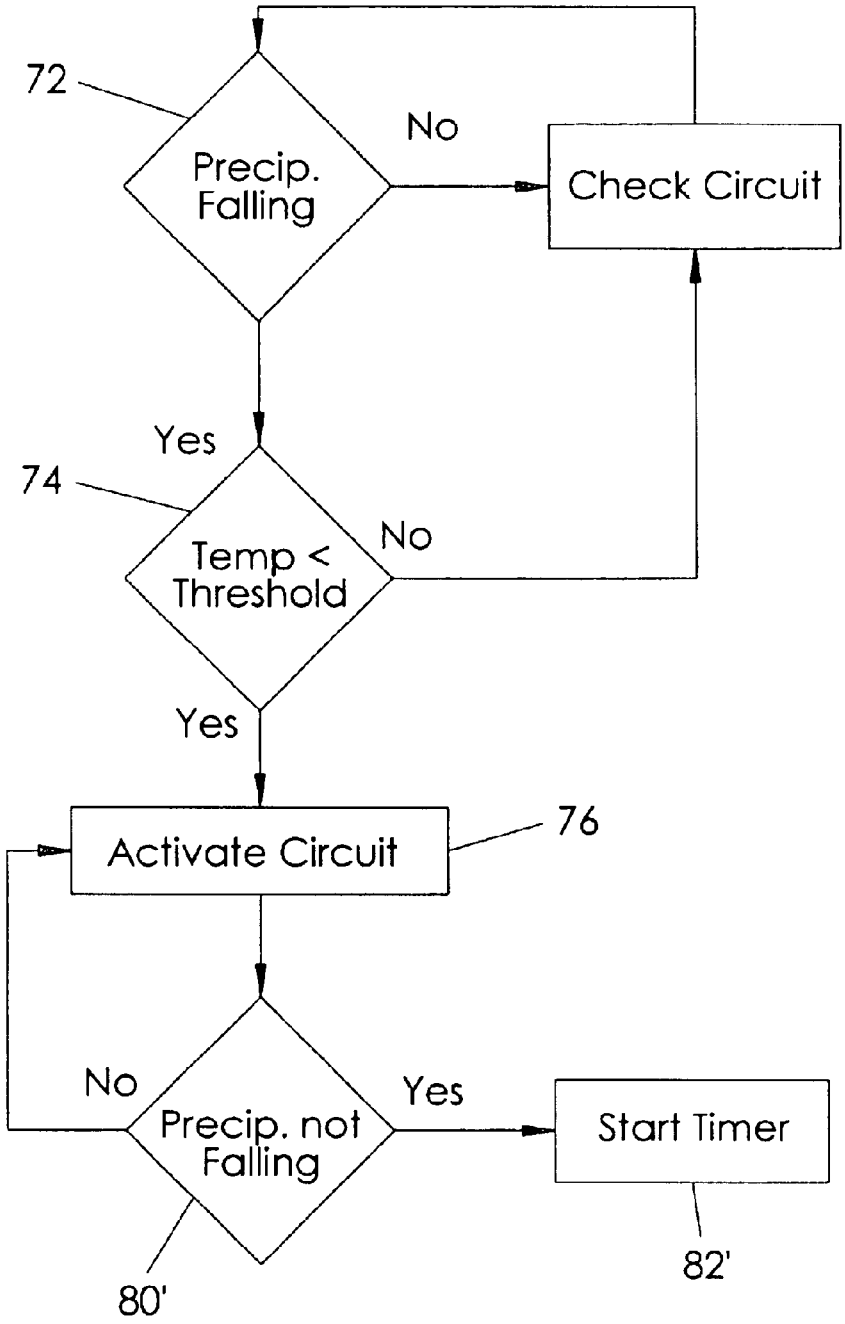
FIG. 12 is a flowchart illustrating the program logic implemented by the CPU according to another mode of operation.

Operation of a second automatic mode 56 is illustrated in FIG. 12. In this mode, the CPU energizes the heating cable 30 as indicated by reference numeral 76 when the precipitation sensor 42 indicates that precipitation is actively falling 72 and the ambient temperature sensor 48 indicates a temperature below a predetermined temperature 74, e.g. 35° F. It is understood that the ambient temperature threshold in this mode is greater than 32° F. as snow can fall at temperatures above 32° F. It is also understood that the precipitation sensor 42 may be vertically oriented to collect and sense falling precipitation and may be self-cleaning with a heating element to evaporate collected precipitation.

The control unit 32 further includes conventional timer circuitry connected to the CPU. As shown in FIGS. 11 and 12, the actuation of the heating cable 30 may be made subject to this timer function. With particular reference to FIG. 11, if the heating cable has been activated 68 but precipitation is not actively falling 80, then the a timer is activated 82 for a predetermined period of time so as to clear any ice dam and then the heating cable 30 is deactivated. Primed reference numerals are utilized in FIG. 12 for this same function.

In addition, a user may select the timer mode 52 to have greater control over how long the heating cable 30 is energized. In the timer mode, a user may select a duration and the remaining time will be displayed on a display screen 37 of the control panel 34. The CPU operates to deactivate the heating cable 30 upon expiration of the selected time.

In use, the ice dam prevention and clearing system 10 may be installed before or after an ice or snow event. In either case, the plurality of wire holding assemblies may be removably attached in longitudinally spaced apart relation along a gutter connected to the edge of a roof surface (FIG. 1). The arm 16 of each assembly 12 may be telescopically length adjusted and may be rotatably oriented in desired lateral positions. The heating cable 30 may be held in place along the arms 16 with the arm fasteners 28. The heating cable 30 may also be positioned in the gutter 2 itself as well as in associated downspouts 4. A user may then select a desired mode of operation using the control panel 34 of the control unit 32. In either of the automatic modes, the CPU evaluates data signals from respective sensors and then actuates the heating cable 30 when predetermined parameters are met. A user may exercise even more control over heating cable activation by selecting the manual or timer mode.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. An ice dam prevention and clearing system for use with gutters and downspouts mounted to a roof, said system comprising:

a plurality of wire holding assemblies, each wire holding assembly having a base releasably connectable to a gutter and an arm rotatably coupled to said base for selectively positioning said arm on said roof, said plurality of wire holding assemblies being spaced apart along said gutter;

a heating cable for generating heat upon receiving electrical current;

means for coupling said heating cable to each arm of said plurality of wire holding assemblies; and a control unit having a central processing unit (CPU) electrically connected to a power source and to said heating cable for selectively delivering electrical current to said heating cable.

2. The system as in claim 1 wherein:

each base is a clip having a generally inverted U-shaped configuration adapted to frictionally engage a front panel of said gutter; and each arm includes a plurality of length-adjustable telescopic sections with a first telescopic section being rotatably coupled to a respective base such that said each arm is laterally movable to a desired position on said roof.

3. The system as in claim 2 wherein said each arm is coupled to a corresponding base with a spring such that said each arm is movable between a closed configuration for contact with said roof and an open configuration displaced from said roof, said spring biasing said each arm toward said closed configuration.

4. The system as in claim 1 wherein said arm is pivotally coupled to said base with a spring coupling and is movable between a closed configuration in contact with said roof and an open configuration displaced from said roof, said spring coupling biasing said arm toward said closed configuration.

5. The system as in claim 1 wherein said heating cable is a conductive PTCR polymeric cable having a plurality of sections that react independently to ambient temperature, each section of said PTCR cable having a heat output that changes in inverse proportion to a change in ambient temperature.

6. The system as in claim 1 further comprising:

a moisture sensor positioned adjacent said heating cable for sensing the presence of moisture, said moisture sensor including means for delivering a moisture data signal to said CPU;

a first temperature sensor positioned on said gutter adjacent said heating cable for sensing a temperature of said gutter, said first temperature sensor including means for delivering a first temperature data signal to said CPU;

a second temperature sensor positioned on said roof adjacent said heating cable for sensing a temperature of said roof, said second temperature sensor including means for delivering a second temperature data signal said CPU;

a selector switch positioned on said control unit that is pivotally movable between "Auto", "Manual", and "Timer" configurations; and means in said CPU for delivering current to said heating cable when said selector switch is in said "Auto" configuration and said moisture data signal is indicative of the presence of moisture and said first temperature data signal is indicative of a gutter temperature less than a predetermined gutter temperature and said second temperature data signal is indicative of a roof temperature greater than a predetermined roof temperature.

7. The system as in claim 6 further comprising:

means in said CPU for delivering current to said heating cable when said switch is in said "Manual" configuration;

a timer circuit positioned in said control unit and electrically connected to said CPU; and means in said CPU for delivering current to said heating cable for a selectable amount of time when said selector switch is in said "Timer" configuration.

8. The system as in claim 1 further comprising:

a selector switch positioned on said control unit that is pivotally movable between "Auto", "Manual", and "Timer" configurations;

means in said CPU for delivering current to said heating cable when said switch is in said "Manual" configuration;

a timer circuit positioned in said control unit and electrically connected to said CPU; and means in said CPU for delivering current to said heating cable for a selectable amount of time when said selector switch is in said "Timer" configuration.

9. The system as in claim 1 further comprising:

a precipitation sensor positioned adjacent said heating cable for sensing the presence of precipitation, said precipitation sensor including means for delivering a precipitation data signal to said CPU;

a temperature sensor positioned adjacent said heating cable for sensing an ambient air temperature, said temperature sensor including means for communicating a temperature data signal to said CPU;

a selector switch positioned on said control unit that is pivotally movable between "Auto", "Manual", and "Timer" configurations; and means in said CPU for delivering current to said heating cable when said selector switch is in said "Auto" configuration and said precipitation data signal is indicative of the presence of precipitation and said temperature data signal is indicative of a temperature less than a predetermined temperature.

10. An ice dam prevention and clearing system for use with gutters and downspouts mounted to a roof, said system comprising:

a conductive PTCR cable for generating heat upon receiving electrical current having a plurality of sections that react independently to ambient air conditions, each section of said PTCR cable having a heat output that changes in inverse proportion to a change in ambient temperature;

a plurality of wire holding assemblies, each wire holding assembly comprising:

a base clip having a generally inverted U-shaped configuration for releasably engaging a front panel of a gutter;

an elongate arm having a plurality of telescopic sections, a first telescopic section being rotatably coupled to said base clip such that said arm is laterally movable for positioning said arm at a desired position on said roof;

wherein said arm includes at least one fastener for retaining said PTCR cable; and a control unit having a central processing unit (CPU) electrically connected to a power source and to said PTCR cable for selectively delivering electrical current to said PTCR cable.

11. The system as in claim 10 wherein said arm is pivotally coupled to said base with a spring coupling and is movable between a closed configuration in contact with said roof and an open configuration displaced from said roof, said spring coupling biasing said arm toward said closed configuration.

12. The system as in claim 11 further comprising:

a moisture sensor positioned adjacent said PTCR cable for sensing the presence of moisture, said moisture sensor including means for delivering a moisture data signal to said CPU;

a first temperature sensor positioned on said gutter adjacent said PTCR cable for sensing a temperature of said gutter, said first temperature sensor including means for delivering a first temperature data signal to said CPU;

a second temperature sensor positioned on said roof adjacent said PTCR cable for sensing a temperature of said roof, said second temperature sensor including means for delivering a second temperature data signal said CPU;

a selector switch positioned on said control unit that is pivotally movable between "Auto", "Manual", and "Timer" configurations; and means in said CPU for delivering current to said PTCR cable when said selector switch is in said "Auto" configuration and said moisture data signal is indicative of the presence of moisture and said first temperature data signal is indicative of a gutter temperature less than a predetermined gutter temperature and said second temperature data signal is indicative of a roof temperature greater than a predetermined roof temperature.

13. The system as in claim 12, further comprising:

means in said CPU for delivering current to said PTCR cable when said switch is in said "Manual" configuration;

a timer circuit positioned in said control unit and electrically connected to said CPU; and means in said CPU for delivering current to said PTCR cable for a selectable amount of time when said selector switch is in said "Timer" configuration.

14. The system as in claim 10 further comprising:

a moisture sensor positioned adjacent said PTCR cable for sensing the presence of moisture, said moisture sensor including means for delivering a moisture data signal to said CPU;

a first temperature sensor positioned on said gutter adjacent said PTCR cable for sensing a temperature of said gutter, said first temperature sensor including means for delivering a first temperature data signal to said CPU;

a second temperature sensor positioned on said roof adjacent said PTCR cable for sensing a temperature of said roof, said second temperature sensor including means for delivering a second temperature data signal said CPU;

a selector switch positioned on said control unit that is pivotally movable between "Auto", "Manual", and "Timer" configurations; and means in said CPU for delivering current to said PTCR cable when said selector switch is in said "Auto" configuration and said moisture data signal is indicative of the presence of moisture and said first temperature data signal is indicative of a gutter temperature less than a predetermined gutter temperature and said second temperature data signal is indicative of a roof temperature greater than a predetermined roof temperature.

15. The system as in claim 10 further comprising:

a selector switch positioned on said control unit that is pivotally movable between "Auto", "Manual", and "Timer" configurations;

a precipitation sensor positioned adjacent said PTCR cable for sensing the presence of precipitation, said precipitation sensor including means for delivering a precipitation data signal to said CPU;

a temperature sensor positioned adjacent said PTCR cable for sensing an ambient air temperature, said temperature sensor including means for communicating a temperature data signal to said CPU; and means in said CPU for delivering current to said PTCR cable when said selector switch is in said "Auto" configuration and said precipitation data signal is indicative of the presence of precipitation and said temperature data signal is indicative of a temperature less than a predetermined temperature.

16. The system as in claim 10 further comprising:

a selector switch positioned on said control unit that is pivotally movable between "Auto", "Manual", and "Timer" configurations;

means in said CPU for delivering current to said PTCR cable when said switch is in said "Manual" configuration;

a timer circuit positioned in said control unit and electrically connected to said CPU; and means in said CPU for delivering current to said PTCR cable for a selectable amount of time when said selector switch is in said "Timer" configuration.

17. An ice dam prevention and clearing system for use with gutters and downspouts mounted to a roof, said system comprising:

a heating cable for generating heat upon receiving electrical current;

a plurality of wire holding assemblies, each wire holding assembly comprising:

a base clip having a generally inverted U-shaped configuration for releasably engaging a front panel of a gutter;

an elongate arm having a plurality of telescopic sections, a first telescopic section being rotatably coupled to said base clip such that said arm is laterally movable for positioning said arm at a desired position on said roof;

wherein said arm includes at least one fastener for retaining said heating cable;

a control unit having a central processing unit (CPU) electrically connected to a power source and to said PTCR cable for selectively delivering electrical current to said heating cable;

a moisture sensor positioned adjacent said heating cable for sensing the presence of moisture, said moisture sensor including means for delivering a moisture data signal to said CPU;

a first temperature sensor positioned on said gutter adjacent said heating cable for sensing a temperature of said gutter, said first temperature sensor including means for delivering a first temperature data signal to said CPU;

a second temperature sensor positioned on said roof adjacent said heating cable for sensing a temperature of said roof, said second temperature sensor including means for delivering a second temperature data signal said CPU;

a selector switch positioned on said control unit that is pivotally movable between "Auto", "Manual", and "Timer" configurations; and means in said CPU for delivering current to said heating cable when said selector switch is in said "Auto" configuration and said moisture data signal is indicative of the presence of moisture and said first temperature data signal is indicative of a gutter temperature less than a predetermined gutter temperature and said second temperature data signal is indicative of a roof temperature greater than a predetermined roof temperature.

18. The system as in claim 17 wherein said heating cable is a conductive PTCR polymeric cable having a plurality of sections that react independently to ambient temperature, each section of said PTCR cable having a heat output that changes in inverse proportion to a change in ambient temperature.

19. The system as in claim 17 further comprising:

means in said CPU for delivering current to said heating cable when said switch is in said "Manual" configuration;

a timer circuit positioned in said control unit and electrically connected to said CPU; and means in said CPU for delivering current to said heating cable for a selectable amount of time when said selector switch is in said "Timer" configuration.

20. The system as in claim 17 wherein said arm is pivotally coupled to said base with a spring coupling and is movable between a closed configuration in contact with said roof and an open configuration displaced from said roof, said spring coupling biasing said arm toward said closed configuration.

* * * * *